US006668439B2

(12) United States Patent
Abplanalp et al.

(10) Patent No.: US 6,668,439 B2
(45) Date of Patent: Dec. 30, 2003

(54) APPARATUS FOR AN IMPROVED GASKETED AEROSOL MOUNTING CUP

(76) Inventors: Robert Henry Abplanalp, Ten Hewitt Ave., Bronxville, NY (US) 10708; Robert R. Blake, Lisboa 72, Burgos de Cuernavaca, Cuernavaca, Morelos 62584 (MX); Timothy O'Toole, 29 Forest Ct., Yorktown Heights, NY (US) 10598

( * ) Notice: Subject to any disclaimer, the term of this patent is extended or adjusted under 35 U.S.C. 154(b) by 0 days.

(21) Appl. No.: 10/216,129

(22) Filed: Aug. 9, 2002

(65) Prior Publication Data

US 2003/0024954 A1 Feb. 6, 2003

Related U.S. Application Data

(62) Division of application No. 09/373,850, filed on Aug. 13, 1999, now Pat. No. 6,431,412.

(51) Int. Cl.[7] ..... B23P 11/00; B21D 51/46

(52) U.S. Cl. ..... 29/243.528; 29/243.519; 29/283; 29/801; 29/888.3; 413/58

(58) Field of Search ..... 29/888.3, 801, 29/623.2, 243.519, 243.528, 251, 282, 283.5; 413/8, 9, 58; 277/312, 313, 316, 592, 604; 220/614, 378; 222/402.1; 429/174

(56) References Cited

U.S. PATENT DOCUMENTS

| | | | | |
|---|---|---|---|---|
| 4,546,525 | A | * | 10/1985 | Abplanalp |
| 4,621,964 | A | * | 11/1986 | Radtke et al. |
| 5,213,231 | A | * | 5/1993 | Abplanalp et al. |
| 5,406,689 | A | * | 4/1995 | Radtke |
| 5,579,944 | A | * | 12/1996 | Hafner et al. |
| 6,158,629 | A | * | 12/2000 | Abplanalp et al. |
| 6,341,711 | B1 | * | 1/2002 | Blake |
| 6,431,412 | B1 | * | 8/2002 | Abplanalp et al. |

* cited by examiner

*Primary Examiner*—Gregory Vidovich
*Assistant Examiner*—Eric Compton
(74) *Attorney, Agent, or Firm*—Kilgannon & Steidl

(57) ABSTRACT

An apparatus for forming a double-segment overlapping gasket material for the mounting cup of an aerosol container comprising a punch mounted on a reciprocating ram having a central opening for the body of the mounting cup and a nose portion adapted to extend within the channel portion of the mounting cup, said nose portion having a specific shape and the punch having a shoulder in the inside diameter of the punch to urge the gasket material disposed on the body portion of the cup into the channel portion, whereat upon the bottoming of the punch against the gasket, a fold line is formed in the gasket which results in the formation of the overlapping double-segment gasket.

3 Claims, 4 Drawing Sheets

APPARATUS FOR AN IMPROVED GASKETED AEROSOL MOUNTING CUP

This application is a divisional application of U.S. patent application Ser. No. 09/373,850 filed on Aug. 13, 1999 naming Robert H. Abplanalp, Robert R. Blake and Timothy O'Toole as inventors, which application issued as U.S. Pat. No. 6,431,412 on Aug. 13, 2002.

BACKGROUND OF THE INVENTION

This invention generally relates to valve mounting assemblies for aerosol containers, said mounting assemblies being commonly referred to as "mounting cups." More particularly, this invention relates to an improved gasket for the mounting cup, i.e., the gasket that forms the seal between the perimetal rim of the mounting cup and the bead of the aerosol container, wherein the sleeve gasket is folded over on itself to provide a double thickness of gasket material disposed within the channel portion of the mounting cup. Also, the invention relates to a method and apparatus for forming the folded-over gasket after the gasket material has been disposed on the mounting cup.

Aerosol containers are widely used to package a variety of fluid materials, both liquid and powdered particulate products. Typically, the product and a propellant are confined within the container, at above atmospheric pressure, and the product is released from the container by manually opening a dispensing valve to cause the pressure within the container to deliver the product through the valve and connecting conduits to a discharge orifice.

The dispensing valve, crimped to a mounting cup having a sealing gasket, is normally mounted in a top opening of the container, which opening is defined by a component commonly referred to as the "bead" of the container opening. The mounting cup includes a central pedestal portion for crimping the dispensing valve, a profile portion extending outward from the pedestal portion, which profile portion merges into an upwardly extending body portion, the body portion emerging into a channel portion terminating in a skirt portion, which channel is configured to receive the bead portion of the container opening. The sealing gasket normally is disposed within the channel portion and in many gasket configurations extends downward along a part of the body portion. After the sealing gasket is disposed onto the mounting cup, the cup is positioned onto the container and the cup is clinched to the container. The clinching operation is well-known to those skilled in the aerosol container art.

In an aerosol container, an effective seal between the mounting cup and the container bead is obviously critical. This seal is accomplished through the sealing gasket, which must prevent the loss of pressure (propellant) through the interface between the container bead and mounting cup.

Various types of sealing gaskets are known in the art. One common type of gasket comprises a conventional flat rubber gasket that is placed inside the channel of the mounting cup. Gaskets of this type are typically manufactured by extruding, molding and vulcanizing the compounded rubber mixture onto rods and then cutting or slicing off thin, annular sections of the extruded and vulcanized product (tube). These gaskets are often referred to as cut or flat gaskets. Cut gaskets are relatively expensive to manufacture. It is very difficult to control precisely the radial dimensions of the tubes from which the cut gaskets are made, the tubes having varying dimensions and being out of round. Consequently, the outer cylindrical surfaces of these tubes are usually machined to the desired dimensions, said machining adding considerable cost to the gasket manufacture.

Another type of gasket comprises a relatively thin sleeve of elastomeric material that is mounted on the body portion of the mounting cup and then advanced along said body so that the gasket extends ultimately into a limited portion of the annular channel of the mounting cup as well as downward along the body portion beyond the annular clinch zone. When the mounting cup is mounted and then clinched onto the aerosol container, the sealing gasket is forced into a sealing engagement with both the channel of the mounting cup and the bead of the container. Typically, these gaskets are forced into a sealing engagement with the mounting cup along only a relatively small circumferential portion of the gasket at positions referred to as the 5 o'clock and 11 o'clock positions. Due to their shape, gaskets of this type are often referred to as sleeve gaskets.

Sleeve gaskets are manufactured by advancing a tube of gasket material onto the body of the mounting cup and then cutting or slicing off annular sections of the tube. The axial heights of sleeve gaskets are substantially greater than the axial heights of cut gasket. Sleeve gaskets are much less expensive to make and assemble to the mounting cup than cut gaskets. When making sleeve gaskets, it is not necessary to machine the outside cylindrical surface of the extruded tubes of gasket material. Moreover, a tubular sleeve gasket may be assembled to the mounting cup more easily than assembling a cut gasket to the mounting cup.

The sealing gasket may also be formed by a liquid material containing water or solvent that is deposited on the annular channel and body portion of the mounting cup. The solvent or water evaporates during curing and the remaining material produces a resilient sealing material in the mounting cup channel. Forming the gasket from a liquid material also is a comparatively expensive procedure requiring multiple production steps including the use of curing ovens or other means to dry and cure the gasket material. Moreover, means must be provided for rotating the mounting cup beneath and relative to a metering apparatus that dispenses carefully determined amounts of a gasket forming composition. These gaskets are commonly referred to as "flowed-in" gaskets. The "flowed-in" gasket system is disfavored due to environmental concerns.

Thus, the above described types of gaskets, as well as others that may be used, have both advantages and disadvantages. Both cut and sleeve gaskets generally produce excellent sealing results. Cut gaskets have seen widespread commercial use for a longer period of time than sleeve gaskets. When using sleeve gaskets on filling and clinching equipment previously used with flat or cut gaskets, a time consuming adjustment must be made to the clinching tool. Often, a clinching line will be required to accommodate both flat and sleeve gaskets, depending on the gasket specifications of the valved container being clinched. To avoid having to make the clinching tool adjustment, with its consequent down-time, there has been a tendency, particularly in Europe, to stay with flat or cut gaskets, even though such gaskets are more costly.

In the past, an attempt has been made to overcome the disadvantages of a cut gasket by converting a specially dimensioned sleeve-type gasket into a cut-type gasket. This attempt is described in U.S. patent application Ser. No. 08/384,736, filed on Feb. 3, 1995. A disadvantage of utilizing the aforementioned sleeve/cut-type gasket is that the apparatus used to manufacture the sleeve-type gasket is designed to handle tubing having a thickness on the order of 0.014". Cut gaskets generally are 0.040" thick, and to manufacture sleeve-type gasket material for conversion into a cut-type gasket of 0.040" or more requires a significant retooling.

U.S. patent application Ser. No. 08/512,533, describes a gasketed mounting cup comprising a sleeve-type gasket that has been folded onto itself to provide a gasket having a double thickness, i.e., a thickness approaching the thickness of a cut gasket; said application further describing that the segments of the folded-over gasket are of uneven length, the segment distal to the under surface of the mounting cup being considerably longer than the segment contiguous to the mounting cup surface. In U.S. patent application Ser. No. 08/037,669, filed on Mar. 10, 1998, there is described a gasketed mounting cup comprising a folded-over gasket for a mounting cup having a flat-bottomed channel portion, wherein the gasket segment distal to the mounting cup has a greater length than the gasket segment contiguous to the mounting cup, this varying length of the segments of the gasket being in combination with a reduction in the width of the channel portion of the mounting cup as compared to conventionally sized mounting cups. Use of a non-conventionally sized mounting cup adds a cost factor.

SUMMARY OF THE INVENTION

An object of this invention is to provide an improved gasketed mounting cup for aerosol containers, an improved method for assembling the gasket to the mounting cup and novel apparatus for forming the gasket of this invention.

Another object of the present invention is to provide a mounting cup for an aerosol container with a sealing gasket that has the manufacturing cost advantages of a sleeve gasket and the advantages of the thickness of a cut gasket in the clinching operation of the aerosol container.

In its broadest aspect, as an article of manufacture, the improved gasketed mounting cup of this invention comprises a mounting cup having a curvilinear channel portion in which is disposed a sleeve-type gasket having plural segments of dissimilar length folded onto each other, which segments are joined at a continuous fold line and positioned such that, when the gasket is ultimately clinched into position in the channel portion of the mounting cup, the fold line is radially outward from the portion of the gasket contiguous to the body of the mounting cup and the length of the folded-over gasket segment distal to the channel portion of the mounting cup is of a greater length than the other segment, however, the longer segment should not have any significant portion, and preferably no portion, thereof contacting the mounting cup during positioning into the channel portion of the mounting cup. If the length of the gasket segment distal to the mounting cup is of a length that a portion thereof abuts or rides against the body portion of the mounting cup, there is an opportunity for the gasket to be wedged against the body portion between the body portion and the bead of the container when the bead attempts to advance the folded-over gasket along the body and into the channel of the mounting cup with the result that the folded-over gasket will not advance into the channel to the desired position and will, thus, produce an imperfect gasketed mounting cup. This is particularly a problem with mounting cups having a curvilinear-shaped channel portion.

The thickness of the individual segments of the gasket will interplay in determining the permissible percent of length increase of the longest segment. The larger the thickness of each segment of the folded-over gasket, the greater is the permitted percent increase of the longer segment of the gasket over the shorter segment. This is for the reason that a shorter segment of greater thickness increases the distance of the longer segment from the surface of the body portion.

In a preferred form of the gasket, the sleeve thickness is 0.022 inches and the length of the gasket segment distal to the mounting cup should be no greater than one hundred twenty-five (125%) percent of the gasket segment contiguous to the mounting cup.

In a still more preferred form of the mounting cup, the fold-over sleeve gasket is an ultra low density polyethylene with an added thermoplastic elastomer.

In the broadest aspect of the method of this invention, the gasket of this invention is formed by advancing the gasket material in the form of a sleeve along the body portion and into the channel portion of the mounting cup and thereat advancing a tool that creates an annular line of compressive force against the gasket thereby causing a continuous fold line in the gasket with the result that the portion of the gasket distal to the body portion of the mounting cup folds over on the other portion of the gasket material, wherein the advancing tool that creates the continuous fold line in the gasket strikes at a point along the length of the sleeve gasket to form folded-over segments of the gasket having the desired relative lengths.

The novel apparatus of this invention comprises a punch that is mounted in a reciprocating manner; the punch advancing the sleeve gasket into the channel portion whereat it advances against the gasket. The working part of the punch has a downwardly and inwardly directed taper on its outer surface, as well as flats on the outer surface that reduce the contact area of the folded-over gasket and the outer surface of the punch and, thereby, preclude dislodgement of the folded-over gasket from the mounting cup during withdrawal of the punch. More detail on the punch is presented hereafter.

Further to the method of forming the gasketed mounting cup of this invention, after the outer portion of the gasket has been folded onto the inner portion, at the point where the gasket is partially in the channel, the gasket is then urged further into the channel portion of the mounting cup. In the mounting cup of the invention, the channel portion of the mounting cup is curvilinear in shape, the gasket is initially disposed upright along the body portion of the mounting cup and slightly into the channel portion contiguous to the body portion of the cup with the free edges of the gasket contiguous to the body portion of the mounting cup. The insertion of the bead of the container into the channel portion advances the gasket to conform to and against the curvilinear shape of the channel portion of the mounting cup.

To dispose the sleeve gasket on the mounting cup prior to forming the fold-over gasket, the sleeve gasket of this invention is initially positioned onto the body portion of the mounting cup. The sleeve gasket is then cut from an extruded tube of gasket material. After cutting, the sleeve gasket is then partially advanced along the body portion of the mounting cup and then further advanced into the annular channel thereof in two separate steps, whereat a compression force against the sleeve gasket results in forming plural segments of the sleeve gasket which fold over onto each other. The apparatus and process for carrying out the steps shown in FIGS. 3A and 3B hereof are described in U.S. patent application Ser. No. 08/512,533, filed on Aug. 8, 1995, the disclosure of which application is hereby incorporated by reference.

Several attempts have been made to simulate cut gaskets for aerosol mounting cups through provision of a folded-over sleeve gasket. In the case of mounting cups having a curvilinear-shaped channel portion, particularly, where the container is aluminum and industry-known eyelashing problem in the bead of the container is present, these attempts have met with imperfect results due to inconsistent positioning of the gasket from its ultimate desired position due to compressibility characteristics in the material of composition of the gasket and in the relative lengths of the segments of the fold-ever gasket. It has been here discovered that with curvilinear-shaped channels, an excessively longer outer gasket segment may provide a contiguous contact to the body portion of the mounting cup for a length sufficient to be clamped between the outside wall of the body of the mounting cup and the bead of the container thereby preventing proper advancing of the gasket to its desired position in the channel. This is a problem peculiar to curvilinear-shaped channels.

Further benefits and advantages of the invention will become apparent from a consideration of the following detailed description given with reference to the accompanying drawings which specify and show preferred embodiment of the invention.

DETAILED DESCRIPTION OF THE PREFERRED EMBODIMENTS

Figure 1:
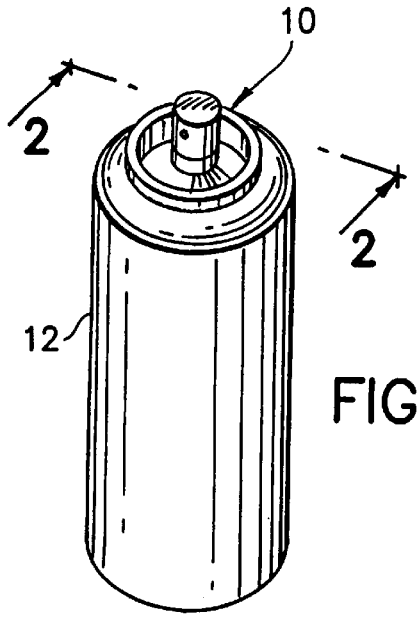
FIG. 1 is a perspective view of a gasketed mounting cup of this invention clinched to an opening in an aerosol container.
Figure 2:
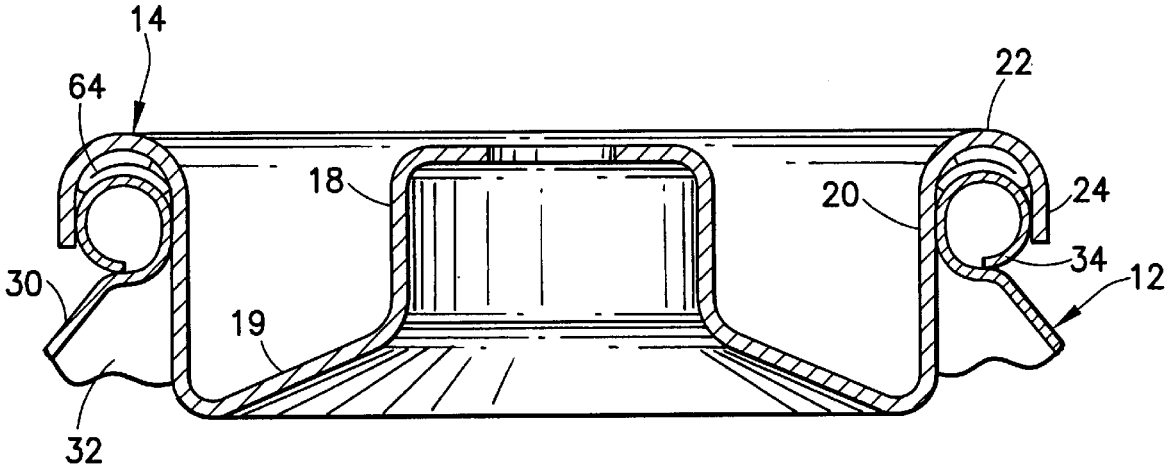
FIG. 2 is a cross-sectional view of the gasketed mounting cup of this invention and a partial cross-sectional view of the aerosol container along the line 2—2 of FIG. 1.

FIGS. 1 and 2 illustrate a valve mounting assembly, generally shown at 10, positioned within the open end 32 of a container 12. More specifically, valve assembly 10 (valve unit not shown) includes a mounting cup, generally designated as 14, and fold-over gasket 64. The mounting cup, in turn, includes a pedestal portion 18, a profile portion 19, and a body portion 20 terminating in a radially outwardly channel portion 22 that receives the gasket 64, the channel portion 22 terminating in the skirt 24. Container 12 includes upper portion 30 that forms central container opening 32 and an upper rolled rim or bead 34 that extends around opening 32. As shown in FIG. 2, channel 22 of cup 14 is mounted on and receives bead 34. Folded-over gasket 64 is disposed between bead 34 and the under surface of channel 22. The bead 34 directly supports the valve mounting assembly 10.

Again, with reference to FIG. 2, in order to connect assembly 10 permanently to container 12, a portion of the body 20 is forced radially outward, underneath bead 34, around the circumference of body 20 thereby clinching the mounting assembly 10 to container 12. This clinching operation also forces gasket 64 into a tight pressure fit against both bead 34 and the under-surface of channel 22, thereby forming an effective seal therebetween. The clinching operation is well known to those skilled in the art.

The gasket configuration and positioning of the gasket of this invention on the mounting cup is formed in a series of steps commencing with the positioning of a portion of a tubular gasket material onto the body portion of an already formed mounting cup. The process for the initial positioning and partial advancement of the tubular or sleeved gasket onto the body portion of the mounting cup and the apparatus for accomplishing these steps are described in U.S. Pat. No. 4,546,525, issued Oct. 15, 1985; the disclosure of said U.S. patent being incorporated by reference herein.

Figure 3A:
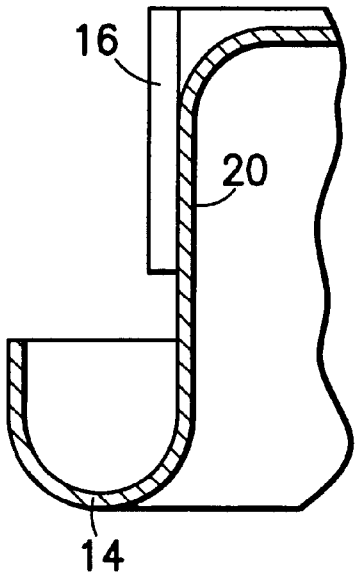
FIGS. 3A–3F is a partial schematic illustrating the sequence of steps in converting an initially disposed sleeve gasket onto a mounting cup through the clinching of the gasketed mounting cup to an aerosol container.
Figure 3B:
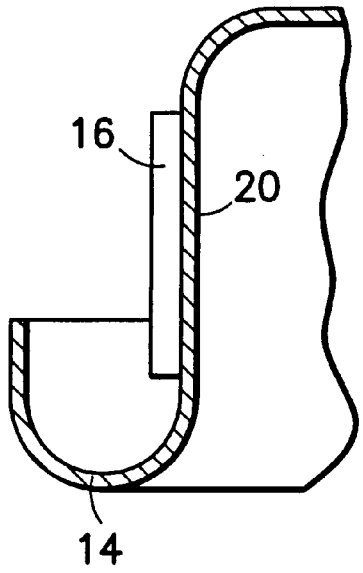
Figure 3C:
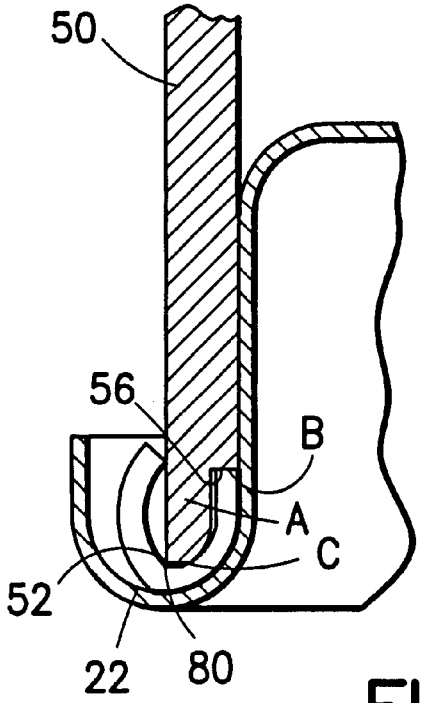

In FIG. 3A is shown a sleeve gasket 16 disposed on the body portion 20 of the mounting cup 14 after the sleeve gasket has been cut from the tubular roll of the gasket. In FIG. 3B, the sleeve gasket 16 is shown partially advanced onto the body portion of the mounting cup. As shown in FIG. 3C, the sleeve gasket is then advanced further onto the body portion 22 and into the channel portion by a punch 50 having a relatively sharp nose portion. Details of the punch construction are described hereafter. By bottoming the relatively sharp nose portion of the punch against the gasket in the channel of the mounting cup and having the mounting cup and a backing supporting member offering an opposing resistance to the force of the punch, a fold line 80 is created in the sleeve gasket which results in the portion of the gasket extending outwardly from the fold line folding onto the portion of the gasket extending inwardly toward the body portion of the mounting cup; thereby forming a dual segment gasket having a double thickness.

Figure 3D:
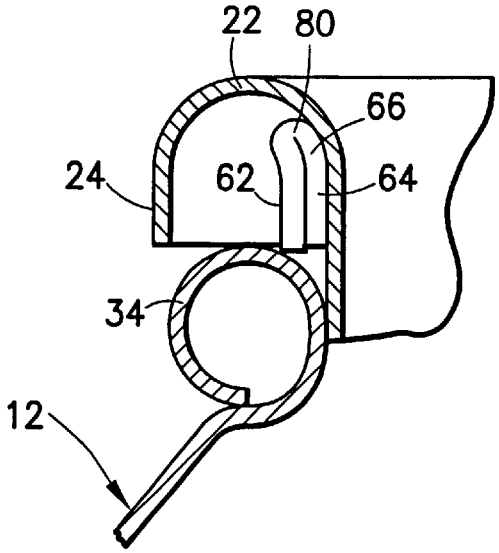
Figure 3E:
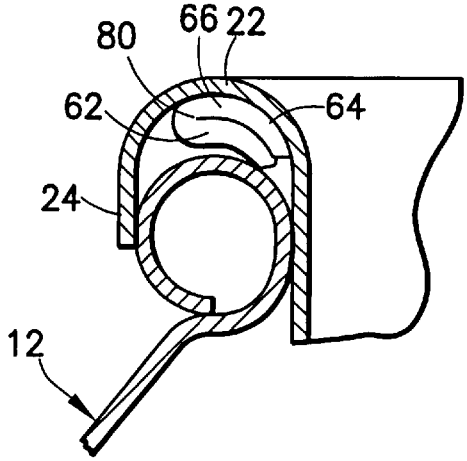
Figure 3F:
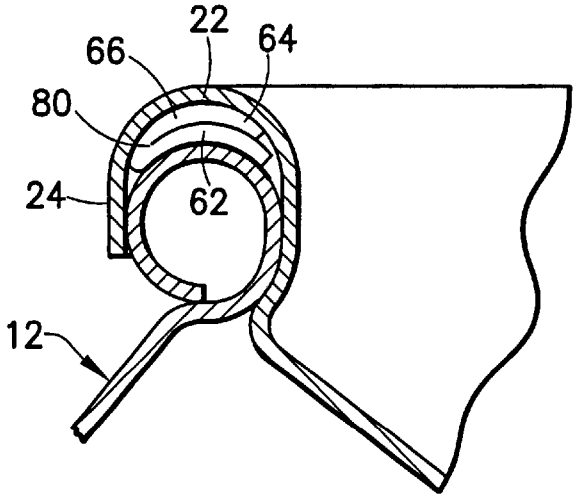

FIGS. 3D–3F show the sequential positioning of the folded-over sleeve gasket through advancing the bead of the container against the folded-over gasket to the ultimate position in FIG. 3F whereat the mounting cup is crimped to the container.

In FIG. 3D, the bead 34 of the container, advances against the outer segment 62 of the folded-over gasket 64, the gasket 64 also having the inner segment 66. The components of FIGS. 3E and 3F are as described for FIG. 3D.

Regarding critical positioning of the folded-over gasket on the channel portion of the mounting cup, it is important, particularly where the mounting cup/aerosol container is to be pressure-filled, i.e., where the propellant is introduced to the container by introducing the propellant by vacuum evacuation in the container through a space between the mounting cup and the bead of the container, that the folded-over gasket not extend beyond the terminal edge of the skirt portion of the mounting cup.

To form the folded-over gasket of this invention, the fold line should be positioned along the length of the sleeve gasket such that a significant portion of the outer segment (segment distal to the mounting cup) folded onto the segment contiguous to the body portion of the mounting cup does not significantly contact the body portion of the mounting cup during the steps of advancing the folded-over gasket along the body and into the channel before its ultimate positioning within the channel portion of the mounting cup. Preferably, the outer segment of the folded-over gasket has a length not longer than one hundred twenty-five percent (125%) of the length of the inner segment. Providing a segmented gasket wherein the outer segment is longer than the inner segment assures that the bead of the container will first contact the outer segment and urge the entire gasket forward along the body of the mounting cup and into the channel. Where the outer segment is of a length significantly less than the inner segment, there is an opportunity for the folded-over segmented gasket to unfold, the outer segment unpeeling from its overlap relation with the inner gasket segment. However, the length of the outer segment should not be of such greater length than the inner segment that a significant portion of the outer segment contacts the body of the mounting cup. A significant portion of excess outer segment is that excess length that permits the outer segment to become wedged between the container bead and the body of the mounting cup and, thereby, foreclose proper entry of the folded-over gasket into the channel portion of the mounting cup. Preferably, the outer segment does not contact the body of the mounting cup.

As noted above, it is critical that the segment of the gasket, extending from the fold line to the terminus of the gasket distal to the body portion of the mounting cup, fold onto the segment of the mounting cup that extends from the fold line to the terminus of the gasket contiguous to the body portion of the cup. With such a fold-over relationship, i.e., having the fold line of the gasket distal to the body portion, any deviation from satisfactory clinching of the mounting cup and the bead of the container that might normally produce a leak path for propellant will be sealed by forcing one segment of the gasket, as shown in FIG. 3F against the underside of the channel portion of the mounting cup and the other segment of the gasket against the bead of the container through capture of the leaking propellant at the fold between the gasket layers. If the fold line of the layered gasket were reversed, i.e., the fold-line were contiguous to the body of the mounting cup, a loose crimp would result in the propellant by-passing the gasket and exiting either between the gasket and mounting cup or between the gasket and the container bead, or both.

The step of FIG. 3C is carried out by mounting a punch 50 (See FIG. 3C) having a continuous edge 52 (see FIG. 6) on a suitable reciprocating ram (not shown). It has been found satisfactory in carrying out the step of 3C to place the inverted mounting cup of FIG. 3B atop a piston surface (not shown) that moves within a four inch (4") cylinder. The cylinder is charged to 20 psi to create a resistive force of 250-plus lbs. against the advancing punch.

In the preferred form of the folded-over gasket of this invention, the radial thickness of the sleeve gasket material, such as is shown in FIG. 3A is twenty-two thousands of an inch (0.022"). When the segments of the gasket are folded on each other, the composite thickness of the gasket is forty-four thousands of an inch (0.044"). It has been found that a folded-over gasket having an outer segment 62 with a length of one hundred fourteen thousands of an inch (0.114") and inner segment 66 with a length of one hundred three thousands of an inch (0.103") provide a satisfactory seal in aluminum mounting cups having a curvilinear channel portion. The composite gasket thickness probably may vary from approximately 0.038" to 0.050".

Figure 4:
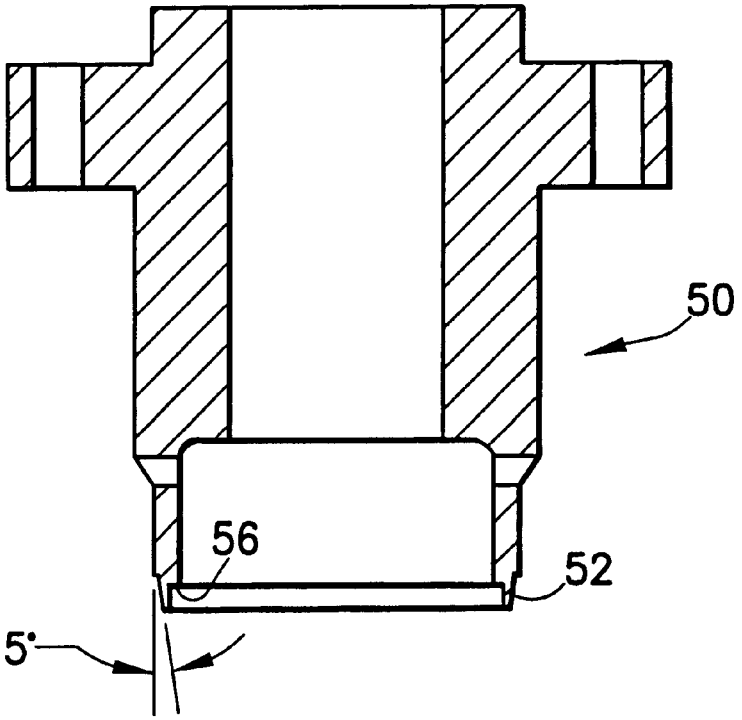
FIG. 4 is a cross-section of the punch for forming the fold line in the gasket.
Figure 5:
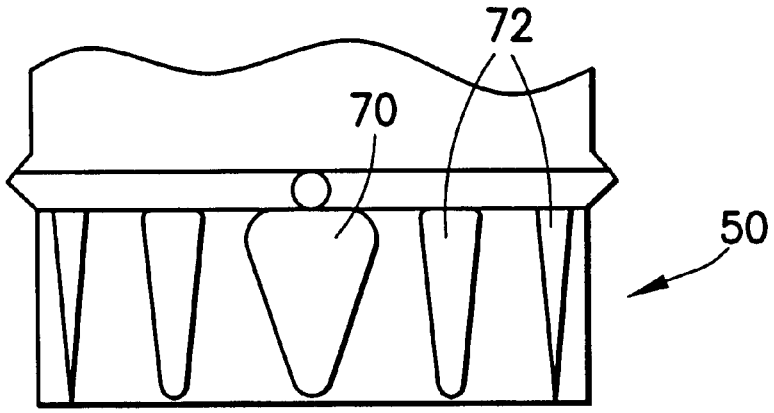
FIG. 5 is an enlarged partial view of the outside surface of the punch of FIG. 4.

FIGS. 4–5 show the structural detail of a punch used to carry out Step 3C of the method of this invention.

In FIG. 4, the punch generally designated as 50, has a leading edge portion 52. Above the edge portion 52 and radially inward on the punch is the step or shoulder 56 which engages the gasket material, as shown in FIG. 3C, to advance the gasket material onto the body and channel portions of the mounting cup to the position shown in FIG. 3C and thereat bottom the punch against the gasket material and create at the annular zone of contact a continuous fold-over line that allows the segment of the gasket material extending radially beyond the hinge to inherently fold over against the segment of gasket material contiguous to the body portion of the mounting cup when the punch is withdrawn.

It has been found that a punch having the following dimensions is satisfactory to provide the preferred fold-over gasket of this invention, having outer and inner fold-over gasket segments of 0.114 inches and 0.103 inches, respectively:

1) "A" (See FIG. 3C) is the lower or working portion of the punch wherein the outer annular surface of this working portion of said punch is downwardly and inwardly tapered at a 5° angle commencing at point 0.375 inches above the bottom edge of the punch; the diameter of the outside of the punch at the upper limit of the taper being 1.150 inches and the corresponding diameter at the lower or nose end of the taper being 1.108 inches.

2) "B" is the step or shoulder in the punch, and the vertical wall below the step or shoulder has a diameter of 1.047 inches, the axial length between the shoulder and the nose of the punch being 0.075 inches.

3) The radius of the nose "C" is 0.040 inches.

The above-described punch is used to form a folded-over gasket with a mounting cup having a body portion with an outside diameter of 0.989 inches, the inner diameter of the punch above the shoulder "B" being 0.994 inches.

To assist in the removal of the punch from the folded-over gasket, the outside surface of the lower portion of the punch has a series of flats cut into said surface as shown in FIG. 5. There are four large flats 70 positioned 90° apart about the peripheral outer surface of the punch and eight smaller flats 72, two between each large flat 70, positioned 30° apart. The peripheral flats provide open spaces between the outside folded-over gasket segment and the surface of the punch, thereby reducing any tendency of the folded-over gasket to adhere to the punch and dislodge from the mounting cup upon withdrawal of the punch forming the fold line. The larger flats allow punch stripper fingers (not shown) to pass between the outer gasket segment and the lower outer punch surface, thereby further aiding in maintaining the positional integrity of the folded-over gasket in the mounting cup.

Following forming the fold line in the gasket and removal of the fold line punch, the gasket is subjected to an advancing arbor having a lower leading edge that contacts the folded-over gasket, the leading edge being tapered upwardly and inwardly, which arbor advances along the body of the mounting cup a predetermined distance so as to position or reposition the folded over gasket at the desired position shown in FIG. 3D. It has been shown that providing a lower arbor surface having a 25° taper will be satisfactory for this step.

Mounting cups of the type described above are well known in the art, and cups may be made in any appropriate procedure and from any suitable material. For instance, cups may be made of metal such as steel, aluminum, and the like and formed into the desired shape through a stamping process.

In addition to the unique folded-over gasket of this invention, it has been found that extraordinary sealing results are attained when the folded-over gasket is made from an ultra-low density polyethylene having some added thermoplastic elastomer present therein. From a multiplicity of materials tested as potential candidates, it has been found that the material described above far excels the other tested candidates as a folded-over gasket material. The material described above is sufficiently resilient to fully seal, but not excessively resilient so as to prevent forming the fold line by the punch.

An example of the aforedescribed gasket material is a material sold by Foreco SRL under the name Foreseal 735. Foreseal 735 has the following physical characteristics:

| Characteristics | Measuring Method | Units | Values Foreseal 735 |
|---|---|---|---|
| Volumetric mass at 23° C. | ISO 1183 (1) | $kg/m^2$ | 900 |
| Melt Flowing Index with 216 kg | ASTM D 238<br>ISO 1133 (2)<br>DIN 53735 | g/10 min | 85 |
| Melting Point | ASTMD 3418 (3) | ° C. | 105 |

The specifications for Foreseal 735 are:

| Characteristics | Measuring Method | Unit | Values Foreseal 735 |
|---|---|---|---|
| vicar softening temperature with 3 kg. | ISO 306<br>DIN 53460 (4) | ° C. | 88 |
| Hardness Shore A | ISO R 868<br>DIN 53505 (4) | | 96 |

(1) Evaluation made on strips of 2 mm thickness formed through compression
(2) Evaluation made on granules
(3) Evaluation made on films of 3 mm thickness
(4) Evaluation made on films of 2 mm thickness There are many advantages to forming the gasket of this invention from sleeve-type gaskets. Among the advantages are:

a) Cost Reduction:
   1) eliminates machine cutting of gaskets;
   2) assembly at higher speeds using sleeve gasket assembly technology;
   3) tubing is extruded without required O.D. machining.

b) Superior Gasket Retention:
   Cut gaskets of the prior art have a tendency to become dislodged from the mounting cup during the handling operations prior to clinching of the gasketed mounting cup. The gaskets of this invention show a marked improvement in stability on the mounting cup. The folding of the gasket at the fold line results in the top segment being highly stretched and thereby acting to maintain the gasket on the mounting cup.

c) Eliminates dust common to machine cutting gaskets.

d) Eliminates problems due to warpage in the cut gaskets of the prior art.

e) With rubber cut gaskets, the industry experiences a so-called "squeeze out" problem familiar to those skilled in the art.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

We claim:

1. An apparatus for forming a fold line in a gasket material for an aerosol mounting cup wherein said fold line yields a double-segment overlapping gasket comprising:

a) a punch mounted on a reciprocating ram having a central opening for receiving the body of a mounting cup and a solid nose portion adapted to extend within the channel portion of a mounting cup;

b) said nose portion having a downwardly and inwardly tapered outer surface terminating in an annular radiused sharp edge; and c) a step or shoulder in the inside diameter of the punch upwardly of the nose adapted to urge the gasket material disposed on the body portion of the mounting cup into the channel portion of the mounting cup whereat the sharp edge forms the fold line upon bottoming the punch against the gasket.

2. The apparatus of claim 1 and further wherein there is a plurality of flats on the outer surface of the nose portion above the terminal edge of the nose portion.

3. The apparatus of claim 2 and further wherein there are four relatively large flats disposed 90° apart on the outer surface of the nose portion and two relatively smaller flats disposed between each of the relatively larger flats disposed 30° apart.

* * * * *